US007269971B2

(12) United States Patent
Huang

(10) Patent No.: US 7,269,971 B2
(45) Date of Patent: Sep. 18, 2007

(54) ELECTROHYDRODYNAMIC EVAPORATOR DEVICE

(75) Inventor: Po-Chuan Huang, Taipei (TW)

(73) Assignee: National Taipei University Technology, Taipei (TW)

( * ) Notice: Subject to any disclaimer, the term of this patent is extended or adjusted under 35 U.S.C. 154(b) by 201 days.

(21) Appl. No.: 11/217,308

(22) Filed: Sep. 2, 2005

(65) Prior Publication Data

US 2007/0051129 A1 Mar. 8, 2007

(51) Int. Cl.
*F25B 39/02* (2006.01)
*F28D 15/00* (2006.01)

(52) U.S. Cl. ..... 62/515; 165/104.23

(58) Field of Classification Search ..... 62/272, 62/229, 498, 515; 165/104.23, 104.24, 104.25; 361/230, 233

See application file for complete search history.

(56) References Cited

U.S. PATENT DOCUMENTS 4,396,055 A * 8/1983 Mitchell, Jr. ..... 165/104.23
6,286,326 B1 * 9/2001 Kopko ..... 62/179
6,374,909 B1 * 4/2002 Jeter et al. ..... 165/96
6,409,975 B1 * 6/2002 Seyed-Yagoobi et al. ... 422/186
6,582,500 B1 * 6/2003 Ohadi et al. ..... 96/61
6,810,946 B2 * 11/2004 Hoang ..... 165/104.26
6,888,721 B1 * 5/2005 Moghaddam et al. ..... 361/700
7,004,238 B2 * 2/2006 Seyed-Yagoobi et al. ..... 165/96
7,108,056 B1 * 9/2006 Moghaddam et al. ..... 165/201
2003/0110790 A1 * 6/2003 Cheng et al. ..... 62/272
2003/0111214 A1 * 6/2003 Seyed-Yagoobi et al. ..... 165/109.1

FOREIGN PATENT DOCUMENTS

SU 706672 A * 12/1979

* cited by examiner

*Primary Examiner*—Mohammad M. Ali

(57) ABSTRACT

An electrohydrodynamic evaporator device (EHD) has an EHD electrode. An electric field is generated upon a fluid of low conductivity inside the evaporator device and an enhanced thermal transport effect is then achieved since a thermal boundary layer near a thermal transport surface is caused to have a greater perturbation while a very small voltage drop. With the EHD utilized, size, weight, cost and required refrigerant amount of the evaporator device are reduced. Further, thermal transport efficiency of the alternative refrigerant is improved, making the EHD evaporator device in compliance with associated refrigerant regulations made by CFC and achieve the purposes of environmental protection and energy saving.

24 Claims, 7 Drawing Sheets

ELECTROHYDRODYNAMIC EVAPORATOR DEVICE

BACKGROUND OF THE INVENTION

1. Field of the Invention

The present invention pertains to an electrohydrodynamic (EHD) evaporator device, and particularly to an electrohydrodynamic evaporator device having an enhanced thermal transport efficiency through generating an EHD effect by use of an electrode.

2. Description of the Prior Art

To improve thermal exchange efficiency of an evaporator, increased surface area, number and associated arrangements of evaporator tube are generally suggested. For example, threads may be added to an interior wall of the evaporator tube to enhance the thermal exchange efficiency. However, this manner may only increase the thermal exchange efficiency passively with results of limited heat exchange effect, prolonged process time and larger volume and weight of the evaporator. Such evaporator may be seen in, for example, the R.O.C. patent no. 546459. In this patent, it is disclosed that refrigerant is provided to cool down a plurality of thermal conducting tubes in a bundle so that heat exchange may be induced between the refrigerant and the thermal conducting tubes and thus the thermal conducting tubes may be cooled down. This cooling device is characterized in that the thermal conducting tubes are grouped and the thermal conducting tube groups are separately arranged.

In the R.O.C. patent no. 543759, an improved fin structure of the evaporator is disclosed in which a saw-like structure is provided at a bottom of the fin. By means of the saw-like structure along with gravity of congealed water generated in the evaporator, the congealed water may be speeded up to flow to a tip of the saw-like structure and then come off from the fin.

In another R.O.C. patent no. 482003, an improved evaporator is disclosed in which a distance liner is provided in a barrel having an inlet and an outlet, the barrel having a cover disposed thereon and the distance liner having a cooling tube disposed there around and extending outward through the cooling tube. This evaporator is characterized in that a hollow tubing element is contained in the distance liner and a spiral piece is welded to an outer surface of the tubing element along a spiral direction so that a spiral tube is formed. And the cooling tube is coiled among the spiral piece in the spiral tube.

However, such evaporator has the following disadvantages. 1. Only a passive improvement in structure is provided and the heat exchange efficiency may not be self-controlled. 2. Since the evaporator may only be improved in structure, dimension, volume and weight of the evaporator may not be efficiently reduced. 3. The amount of the refrigerant required for the evaporator may not be reduced.

In view of these problems encountered in the prior art, the Inventors have paid many efforts in the related research and finally developed successfully an electrohydrodynamic (EHD) evaporator device, which is taken as the present invention.

SUMMARY OF THE INVENTION

The present invention provides an electrohydrodynamic (EHD) evaporator device capable of actively controlling heat transport efficiency of refrigerant used therein.

The present invention further provides an EHD evaporator device having a reduced dimension, volume and weight.

Moreover, the present invention provides an EHD evaporator device having a reduced amount of refrigerant required therefore.

The EHD evaporator device according to the present invention comprises an evaporators which has one or more electrodes, the evaporator is a case having a plurality of openings thereon and one or more metal tubes therein each being filled with a working fluid, one or more insulation seats disposed at a refrigerant inlet/outlet or a refrigerant transition so as to avoid electric arc caused by a high voltage when an insufficient insulation is existed between electrodes from occurring, an insulated support member used to fix an electrode and isolate the electrode and metal tube, a voltage applicable insulator comprising a voltage applicable insulator and a voltage applicable insulator and inputtable by a high voltage and one or more electrodes disposed in the working fluid and capable of generating an electric field, wherein the working fluid is filled in the metal tube of the evaporator and the electrode is disposed in the working fluid and fixed with the insulated support member and connected to the insulation seat of the voltage applicable insulator at one end, the voltage applicable insulator being installed at an opening of the evaporator case so as to be connected to a high voltage power supplying device.

DETAILED DESCRIPTION OF THE PREFERRED EMBODIMENT

The present invention discloses an electrohydrodynamic (EHD) evaporator device and will be described below with one used in a refrigerant R-22 iced water system as an example.

Figure 1:
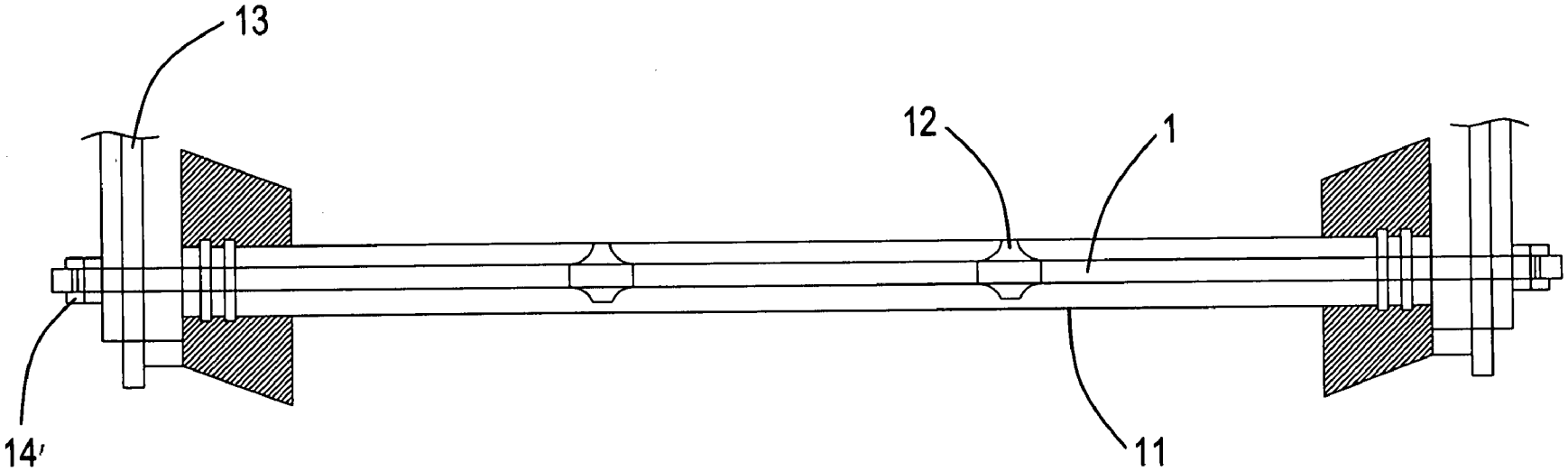
FIG. 1 is a schematic diagram of an electrohydrodynamic (EHD) evaporator device according to the present invention.

Referring to FIG. 1, a schematic diagram of the EHD evaporator device according to the present invention is shown therein. In the EHD evaporator device, an electrode 1 is disposed in a copper tube 11 having an inner wall manufactured in a macro-fin form. An insulated support element 12 is provided to fix the electrode 1 at a specific position in relation to the copper tube 11, so that the electrode 1 (served as a positive electrode) and the copper tube 11 (served as a negative electrode) may be exempted from contact with each other. In addition, an insulation seat 13 is provided at each end of the electrode 1 and the copper tube 11 for fixation thereof.

Figure 2A:
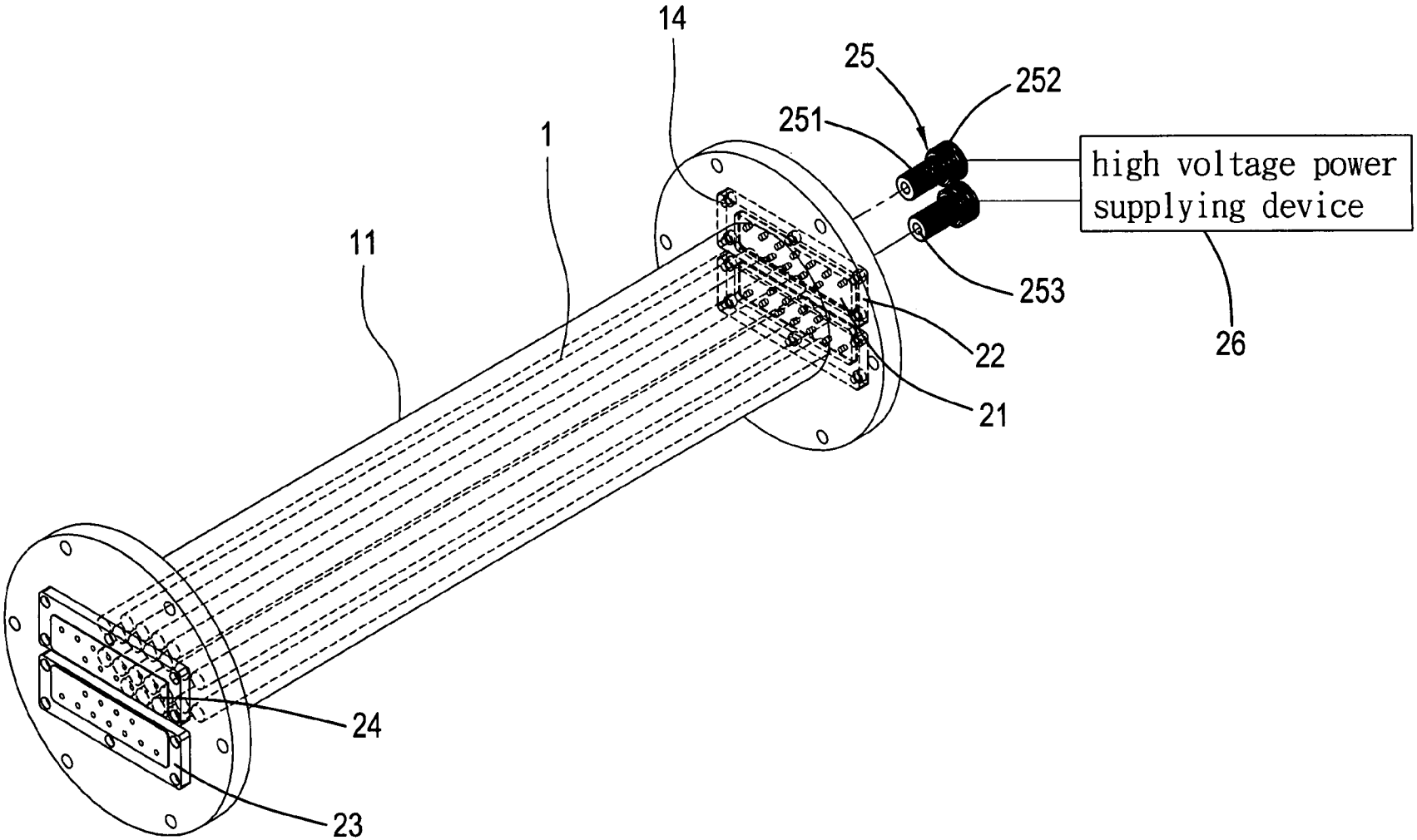
FIG. 2A is a perspective view of the EHD evaporator device according to the present invention.

Referring to FIG. 2A, a perspective view of the EHD evaporator device according to the present invention is shown therein. The EHD evaporator is formed by combining the electrode rods 1, the stainless steel screw nuts 14, the first electrode conducting plate 21, the first insulation seat 22 at a transition end, the second conducting plate 23, and the second insulation seat 24. A refrigerant is provided to enter a lower part of the evaporator and then pass the second conducting plate 23 and a bottom of the insulation having a pad. Then, the refrigerant flows back and out the evaporator through the upper part of the evaporator after flowing to an indentation channel within the first insulation seat 22 opposite to the copper tubes. A Teflon-made insulator 25 for insulation of high voltage is provided on insulation wires at the transition end of the evaporator so that a high voltage may be inputted to the evaporator with safety guaranteed. The insulator 25 comprises a male high voltage applicable insulator 251, a female high voltage applicable insulator 252 and a conducting rod 253. A direct current (DC) high-voltage supplying device 26 is provided to supply a high voltage (up to 30 kV) to the electrodes of the evaporator of variable refrigerant volume (VRV) type of the EHD evaporator device. The high voltage is used to de-ionize the refrigerant into a dielectric fluid with the aid of an electric filed, an EHD effect is in this manner generated.

Figure 2B:
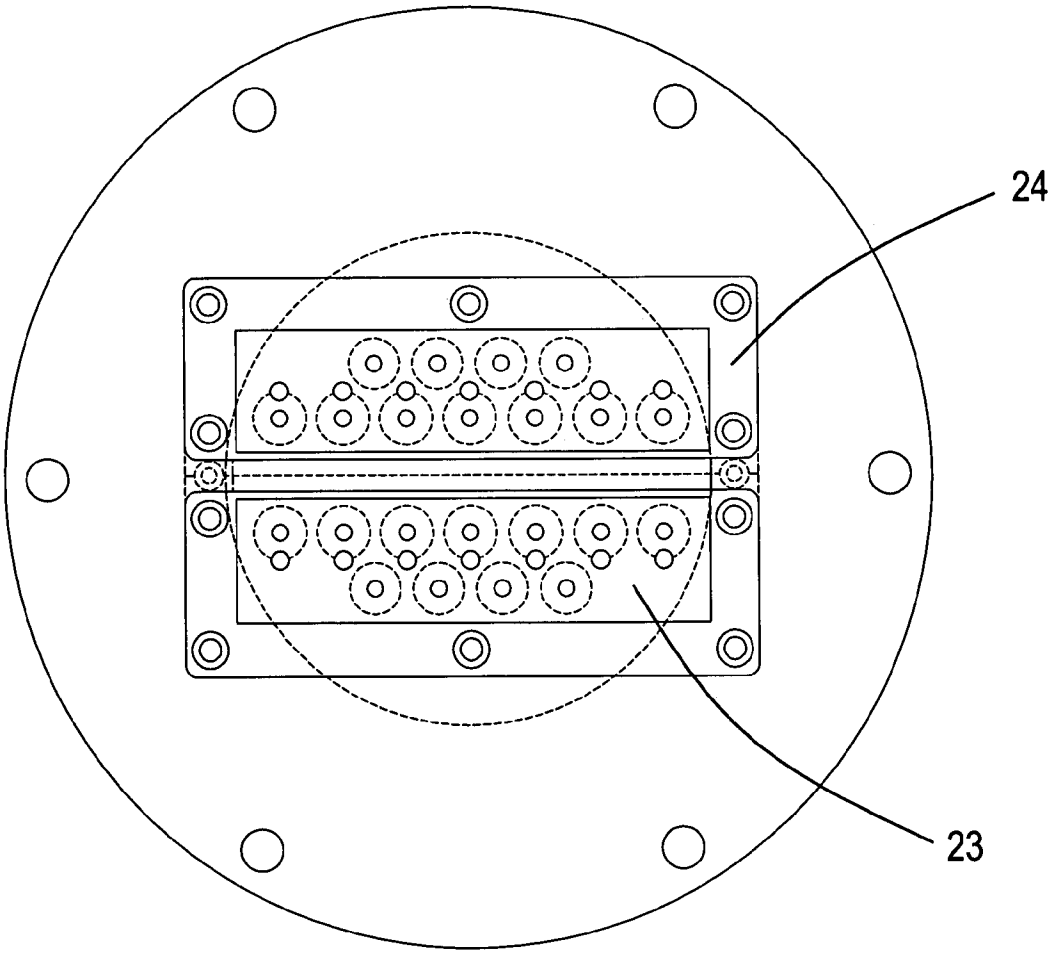
FIG. 2B is a cross sectional view of an inlet and outlet end of an embodiment of the EHD evaporator device according to the present invention.

Referring to FIG. 2B, a cross sectional view of the inlet/outlet end of an embodiment of the EHD evaporator device according to the present invention is shown therein. In the EHD evaporator device, the copper tubes are arranged in an alternative form. The second insulation seat 24 is devised to have an upper part and a lower part so that a positive semi-cycle and negative semi-cycle of the inputted high voltage may be presented in several configurations with respect to the upper and lower parts of the second insulation seat 24. Specifically, it is possible to present the positive semi-cycle of the high voltage on the upper part of the second insulation seat 24 only, the negative semi-cycle of the high voltage on the lower part of the second insulation seat 24 only or the positive semi-cycle of the high voltage on the upper and lower parts of the second insulation seat 24 concurrently.

Figure 2C:
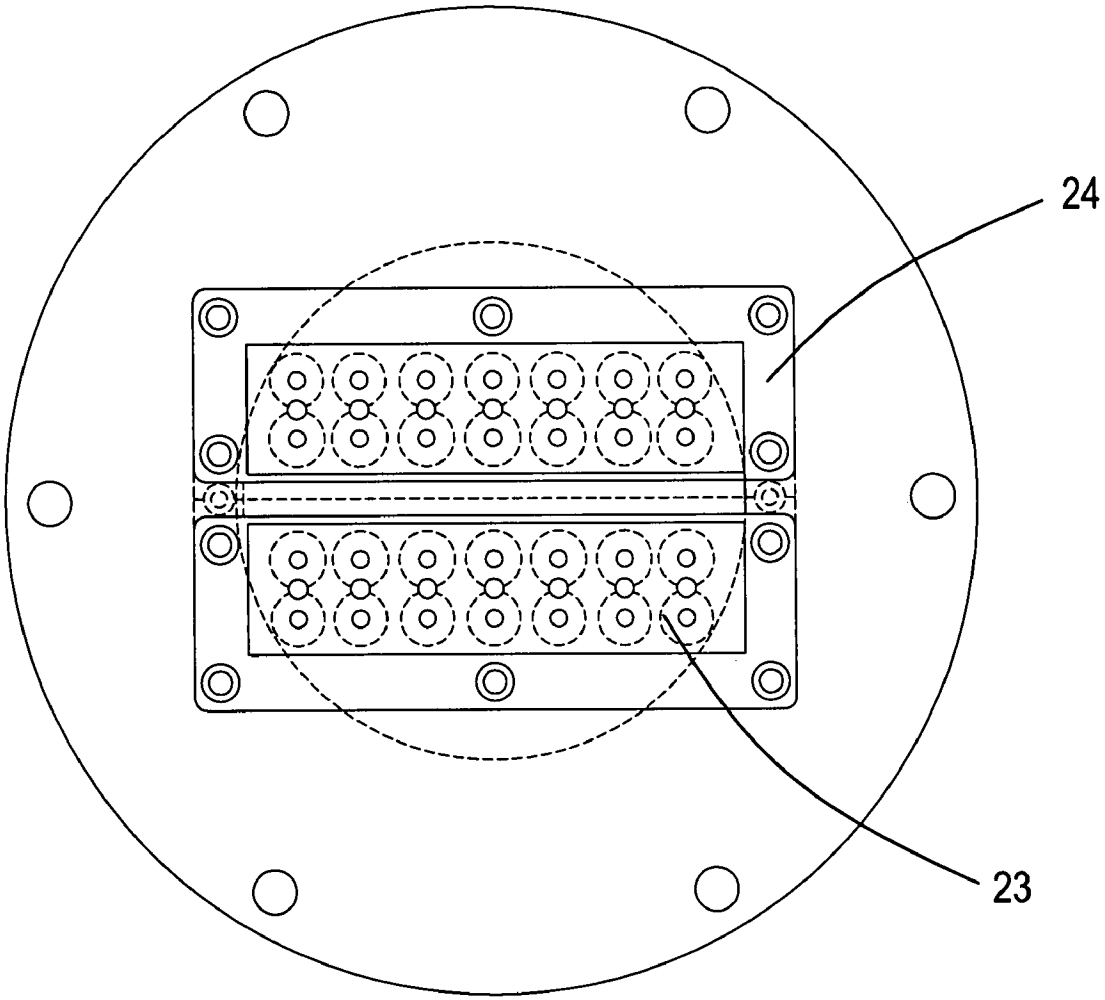
FIG. 2C is a cross sectional view of the inlet and outlet end of another embodiment of the EHD evaporator device according to the present invention.

Referring to FIG. 2C, a cross sectional view of another embodiment of the inlet/outlet end according to the present invention is shown therein. As shown, the copper tubes are arranged orthogonal to one another.

Figure 3:
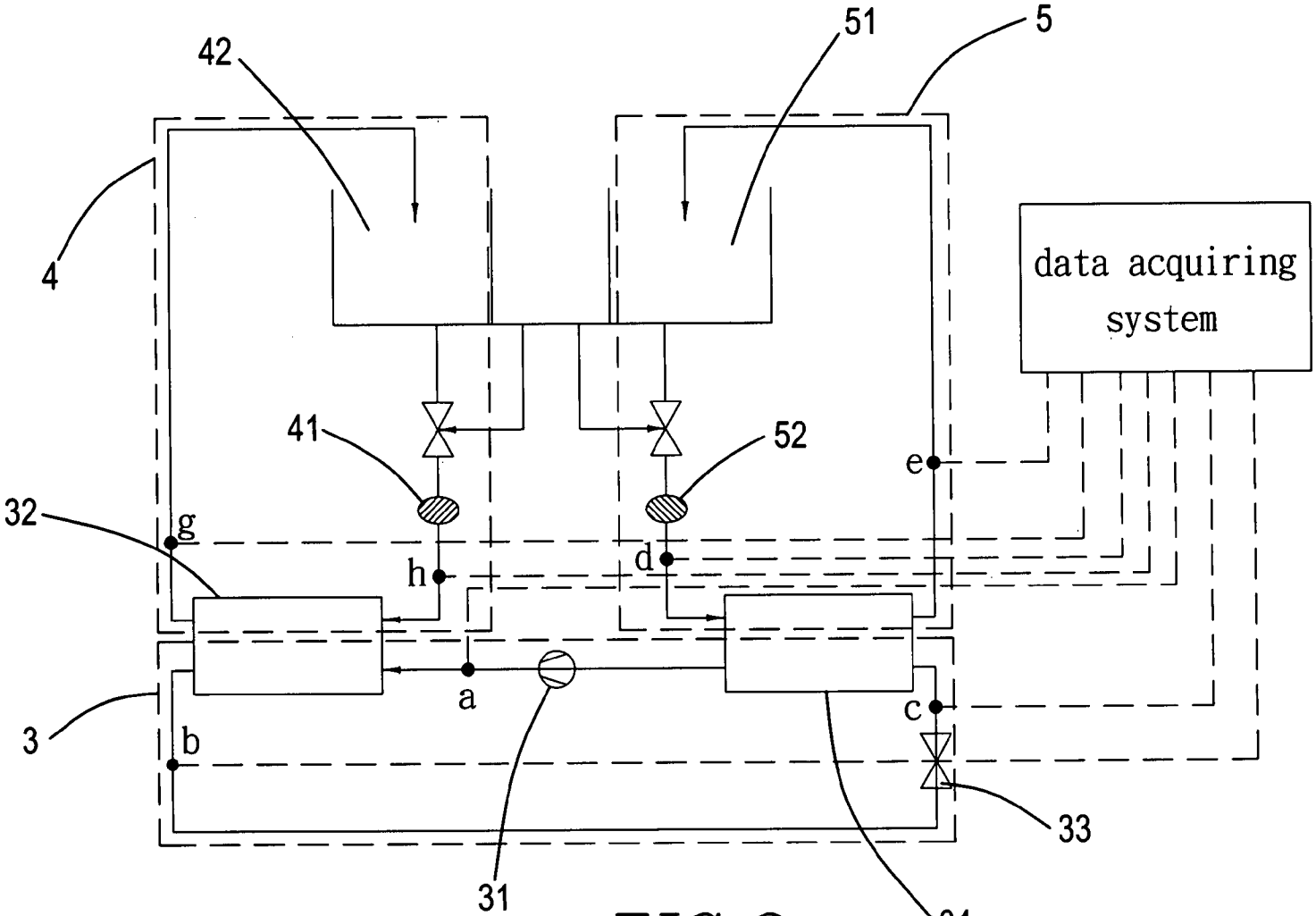
FIG. 3 shows a schematic diagram illustrating a combination of an EHD evaporator iced-water machine and a refrigeration performance testing system according to the present invention.

Referring to FIG. 3, a schematic diagram illustrating a combination of an iced-water mainframe having the EHD evaporator and a refrigeration performance testing system is shown therein. In the exemplified EHD evaporator iced-water machine, refrigerant of R-22 type is served as a working fluid. In the evaporator, the refrigerant flows through the copper tubes and iced water flows circumferentially with respect to the copper tubes, the refrigerant and the iced-water being in a cross-flow relationship. An iced water flowing area is defined at between the copper tubes and the evaporator.

The gaseous refrigerant is introduced to a compressor 31 and then into a condenser 32. After being subject to a high pressure process and thus condensed, the refrigerant flows out the condenser 32 in a liquid form. Then, coolness of the liquid refrigerant is adjusted and then reduced in pressure by an expansion valve 33. Then, the refrigerant is flown into the evaporator 34 and becomes a refrigerant of low pressure and temperature and a specific dryness. In the evaporator 34, the refrigerant first flows through a lower part thereof and then diverts through an upper part thereof. The refrigerant flow is presented in a mixed form including a gaseous phase and a liquid state. The boiled refrigerant becomes gaseous after heat absorption and drawn back by the compressor 31. By repeating this operation principle, the compressor device performs an evaporation task.

The refrigeration performance testing system is composed of an iced-water mainframe refrigerant system 3, an iced-water circulation system 4 and an iced-water circulation system 5. When the testing system performs, the cooling water receives heat transmitted from the gaseous refrigerant (the cooling water flows within the copper tubes while the refrigerant at the high voltage side flows between outside the copper tubes and the iron case).

The water of 32° C. is transmitted to a water tower 42 by means of a water pumping 41 and cooled down in the water tower 42 and then the water returns to the condenser 32. In this manner, the water circulation system 4 operates. In the EHD evaporator, the iced water transmits its heat to the lower pressure refrigerant in the evaporator, through which the water is reduced in temperature from 12° C. to 7° C. Then, the water flows out the evaporator 32 and into a windmill for heat absorption thereby. Then, the water is directed to a constant temperature water trough 51 and then returns to an inlet of an iced water pumping 52. Finally, the water flows into the evaporator from an outlet of the iced water pumping 52. The cooling water circulation system 4 and iced water circulation system 5 jointly control the mixed state of the refrigerant to keep the stability of the load.

To test refrigeration performance (kJ/h) of the iced-water mainframe when the EHD evaporator is operated under some conditions, parameters associated therewith have to be measured, such as cooling water circulation amount, iced water circulation amount (m3/h), temperature (° C.) and temperature difference of the cooling water when entering and leaving the condenser, jet pressure (bar) of the refrigerant from the compressor, temperature of the jet port of the refrigerant (° C.) in the condenser, temperature of the inlet/outlet of the liquid refrigerant, temperature of the inlet/outlet of the refrigerant from a super cooler (° C.), an overexpansion valve, temperature of the inlet and outlet of the refrigerant in the evaporator, pressure of the inlet and outlet of the refrigerant in the evaporator, and temperature and pressure of the drawing port of the compressor. The measurement points are (1) a jet port a of the compressor, (2) a liquid outlet b of the condenser, (3) an inlet c of the evaporator, (4) an inlet d and outlet e of an iced water tube, (5) an inlet g and an outlet h of the cooling water tube and the like. Further, the amount of the iced water and cooling water are also required to be measured.

A three-phase voltage three current power factor detection system is used test a power consumption amount of the compressor. With the refrigeration performance testing system and the power consumption detection system, an energy efficiency ratio E.E.R. and a refrigerant system performance coefficient C.O.P may be obtained based on the message from the refrigeration performance testing system and the power consumption detection system.

Now the description will be made to a measurement operation of the iced-water mainframe performance testing system.

1. After the mainframe is initialized, the operation of the mainframe is tested. When the mainframe is stably operated with a full load presented, temperature of the cooling water when entering and leaving, temperature of the iced water when entering and leaving, circulation amount of the cooling water, circulation amount of the iced water, consumption power of the compressor and the like are measured and recorded.

2. When the mainframe is operated to the full load being presented, the high voltage EHD device is enabled and maintained at a specific high voltage. When the high voltage is applied on the iced water mainframe, the operation thereof is observed and the high voltage is adjusted. Further, an upper and lower pressure and the circulation amount of the refrigerant are recorded.
3. Increasing the EHD) voltage for several times, then recording the associated data until spark discharge occurs.
4. To observe the operation when a partial load is presented, the constant temperature trough is adjusted so that the temperature of the iced water at the outlet Then, a high voltage is applied on the iced water mainframe and the operation is observed and recorded.
5. Changing the dryness of the refrigerant and repeating the above mentioned steps, and then recording completely the associated data.

Figure 4:
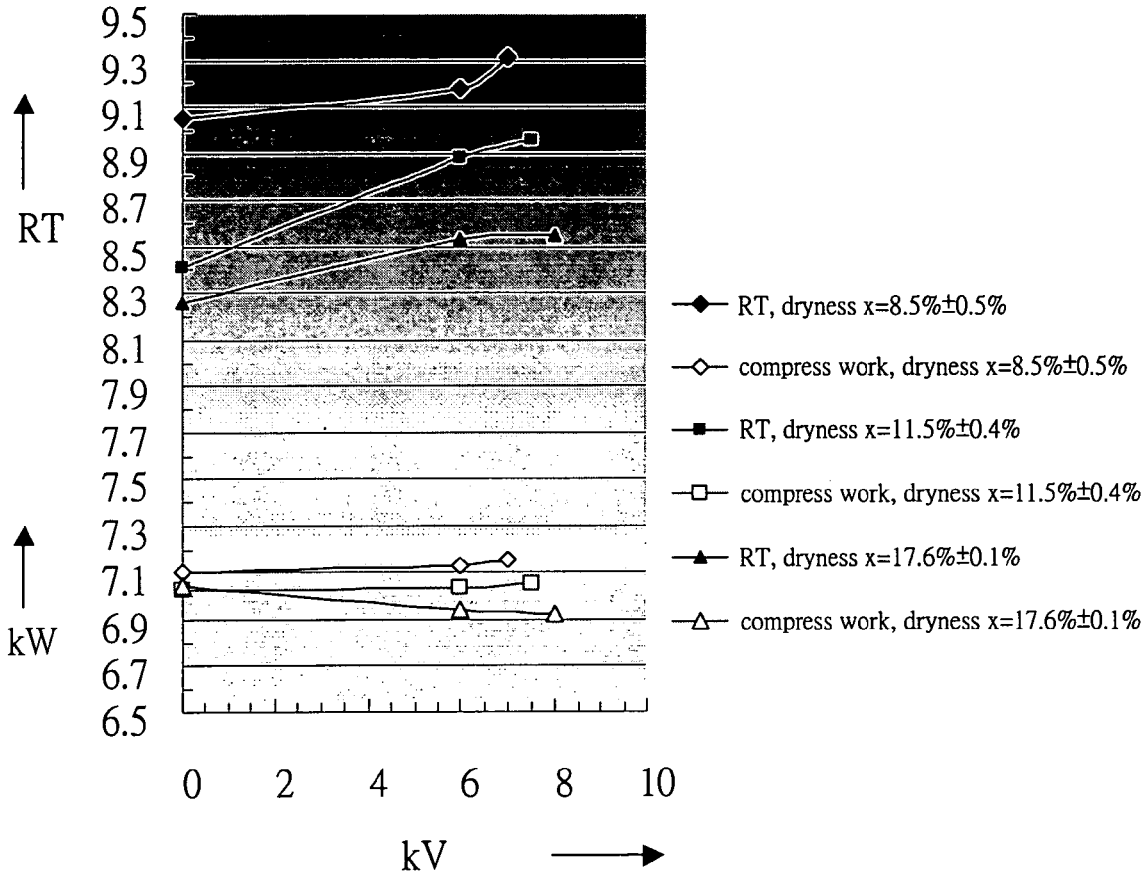
FIG. 4 is a relationship plot of the EHD voltage and the refrigeration performance and consumption of the iced water mainframe with respect to different dryness of the inlet of the refrigerant according to the present invention.

Referring to FIG. 4, a relationship plot of the EHD voltage and the refrigeration performance and consumption of the iced water mainframe with respect to different dryness of the inlet of the refrigerant according to the present invention is shown therein, with the refrigerant flow rate fixed at 10 kg/min. As shown, the refrigeration performance increases as the EHD voltage increases. When the voltage is up to 6 kV, increase of the refrigeration tones RT becomes milder as the EHD voltage increases until the voltage is up to 8 kV. The iced water refrigeration tones RT increases is simply because the gaseous and liquid refrigerant in the tube becomes more separable due to the applied field.

On the other hand, the iced water refrigeration tones RT decreases is simply because the refrigerant in the tube becomes gradually drier and thus the gaseous and liquid refrigerant is less separated. Further, the decrease of the refrigeration tones is also resulted from a smaller convection generated by the then EHD voltage upon the gaseous refrigerant.

When the fed refrigerant becomes drier, the refrigerant in the tube will become 100% dry in a more rapid speed, leading to a flattened increase of the refrigeration performance after the inputted EHD voltage reaches 6 kV. When the EHD voltage reaches 8 kV, the inputted voltage cannot increase again since a voltage breakdown mechanism is occurred in the evaporator. It may also be known through FIG. 4 that increase rates of the refrigeration tone (RT) with respect to the refrigerant dryness when the different EHD voltages are applied have an average of 3%. When operated with different dryness of the refrigerant, the expansion valve in the refrigerant system may automatically admit a larger amount of the refrigerant flown through when an increase of overheatness is sensed by a temperature-sensing bladder of the expansion vale. In this case, the refrigerant amount fed into the evaporator increases, resulting in an increase of the total refrigeration performance. At this time, the optimal refrigeration performance of the iced water mainframe is 112.84% (9.315RT/8.256RT=112.84%) as compared to that without any EHD voltage applied, i.e. an increase of 12.8%.

Now, the consumption energy kW of the compressor of the iced water mainframe is discussed below. Referring also to FIG. 4 (a lower part therein), when the EHD voltage increases, the consumption energy kW becomes smaller as the refrigerant dryness at the inlet increases. Specifically, when the refrigerant dryness becomes greater than 17%, the consumption energy of the compressor reduces as the EHD voltage increases, compared with the cases shown in an upper part of FIG. 4. This is because that the EHD causes that heat resistance of the heat exchanger is reduced and saturated temperature of the refrigerant system at a low pressure is nearer the cooling water temperature. Namely, since the saturated temperature at a low pressure rises a bit and the pressure at the inlet of the compressor also rises a bit, a required compress work for the compressor is reduced. When the refrigerant dryness is reduced to be smaller than 9%, the compressor consumption energy increases gradually as the EHD voltage increases, with an increase rate of the consumption energy of 0.73%. This is because that the smaller the dryness of the refrigerant at the inlet is, the more the liquid refrigerant amount is, leading to a larger EHD force and an improved thermal exchange performance with an increase rate of 2.92% (9.315/9.051) as compared to that when the above dryness and refrigerant circulation amount are used.

Figure 5:
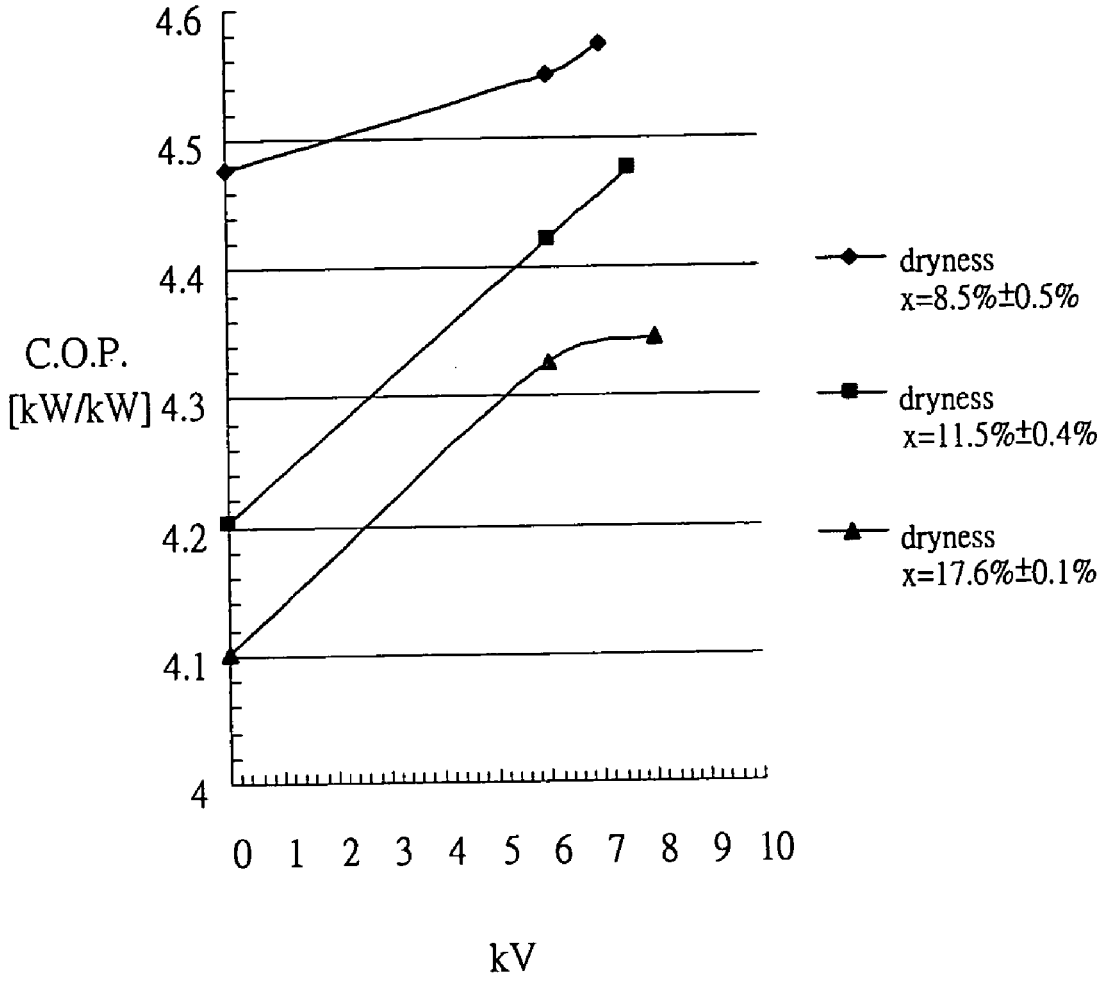
FIG. 5 is a relationship plot of the EHD voltage and the iced water mainframe performance coefficient COP with respect to different refrigerant dryness at the inlet according to the present invention.

Referring to FIG. 5, a relationship plot of the EHD voltage and an iced water mainframe performance coefficient COP (defined as a ratio of the heat absorption amount QL of the evaporator and the compress work required for the compressor) with respect to different refrigerant dryness at the inlet, with a flow rate of the refrigerant fixed at 10 kg/min, is shown therein. For a same compressor, the performance coefficient COP is proportional to the heat absorption amount QL of the evaporator. As shown, it may be known that the performance coefficient COP of the iced water mainframe increases as the EHD voltage increases, resulting in an increased consumption energy of the EHD power supply.

In conclusion, the present invention has at least the following advantages.

1. As compared to the conventional iced water mainframe, the refrigeration performance of the invention is enhanced up to 12.82% according to the experiment when the overcoolness, dryness, overheatness of the refrigerant are efficiently +adjusted so as to optimize the thermal transport efficiency of the thermal exchanger.
2. With the EHD evaporator device applied, the refrigeration performance is enhanced over 12% with the cases when a high voltage and a low current are applied and not applied, while only an increase of 1.6% of the consumption power of the compressor is required.
3. The EHD evaporator device may be installed in a VRV evaporator to enhance refrigeration performance by slightly changing the arrangement of the iced water mainframe without changing the mainframe and the associated tools.
4. The EHD evaporator can be cost efficient and worthy of being used. Now assuming an EHD evaporator is installed in an iced water mainframe of 300 RT to 350 RT and 12% of refrigeration tones are additionally provided thereby, a corresponding increase of 35 RT to 42 RT of refrigeration tone is achieved. Cost wise, installation of an EHD evaporator device is approximately lower than 30,000 USD and the high voltage device at the heart thereof is approximately lower than 100,000 to 120,000 USD.
5. The EHD-based thermal transport enhancement technology may be further used in a compressor, a flooded evaporator and a future refrigerant system.

As compared to the prior art, the EHD evaporator device disclosed in the present invention further has the following advantages.

1. The structure and installation method of the EHD evaporator device are simpler and power consumption thereof is lesser, compared with other active thermal transport enhancement technologies.

2. A relatively lower cost is required since only a transformer, a wire and plate electrode and an insulation material is required.
3. The thermal transport efficiency may be rapidly controlled by adjusting strength of an electric field applied on the EHD evaporator device.
4. Flow field or cooling effect may be partially improved in the delivery tubes.
5. The EHD technology may be used for the CFC refrigerant, other alternative refrigerants, such as R-123, R-134a, and gas (owing to the low conductivity).
6. The EHD evaporator device may be used even in outer space environment where gravity is not existed.
7. The insulation seat is particularly designed and thus electric arc generated owing to an insufficient insulation existed between conducting plates may be prevented.
8. Since the insulated support member is provided to fix the electrode and isolate the electrode and metal tube, a longer electrode of such kind may not be broken.

While embodiments and applications of this invention have been shown and described, it would be apparent to those skilled in the art having the benefit of this disclosure that many more modifications than mentioned above are possible without departing from the inventive concepts herein. The invention, therefore, is not to be restricted except in the spirit of the appended claims and their equivalents.

What is claimed is:

1. An electrohydrodynamic (EHD) evaporator device, comprising:

an evaporator being a case having a plurality of openings thereon and a metal tube therein being filled with a working fluid;

an insulation seat disposed at a refrigerant inlet/outlet or a refrigerant transition so as to avoid electric arc caused by a high voltage when an insufficient insulation is existed between electrodes from occurring;

an insulated support member used to fix an electrode and isolate the electrode and metal tube;

a voltage applicable insulator comprising a voltage applicable insulator and inputtable by a high voltage; and one or more electrodes disposed in the working fluid and capable of generating an electric field, wherein the working fluid is filled in the metal tube of the evaporator and the electrode is disposed in the working fluid and fixed with the insulated support member and connected to the insulation seat of the voltage applicable insulator at one end, the voltage applicable insulator being installed at an opening of the evaporator case so as to be connected to a high voltage power supplying device.

2. The EHD evaporator device according to claim 1, wherein a material of the metal tube in the evaporator comprises copper.

3. The EHD evaporator device according to claim 1, wherein the metal tube in the evaporator has an interior wall manufactured as a plurality of micro-fin having interior threads.

4. The EHD evaporator device according to claim 1, wherein the metal tube in the evaporator is served as a ground end.

5. The EHD evaporator device according to claim 1, wherein the working fluid has a dielectric constant of 6 to 30.

6. The EHD evaporator device according to claim 1, wherein the working fluid is refrigerant.

7. The EHD evaporator device according to claim 1, wherein the working fluid is alternative refrigerant.

8. The EHD evaporator device according to claim 1, wherein a material of the insulation seat of the voltage applicable insulator comprises Teflon.

9. The EHD evaporator device according to claim 1, wherein the insulation seat of the voltage applicable insulator has a maximum bearable voltage of up to 40 kV.

10. The EHD evaporator device according to claim 1, wherein the insulation seat of the voltage applicable insulator has a maximum bearable refrigerant pressure of up to 20 bar.

11. The EHD evaporator device according to claim 1, wherein a shape of the electrode comprises a rod shape.

12. The EHD evaporator device according to claim 1, wherein a shape of the electrode comprises a line shape.

13. The EHD evaporator device according to claim 1, wherein a shape of the electrode comprises a spiral shape.

14. The EHD evaporator device according to claim 1, wherein a shape of the electrode comprises a tube shape having a small diameter.

15. The EHD evaporator device according to claim 1, wherein a shape of the electrode comprises a spiral and line mixed shape.

16. The EHD evaporator device according to claim 1, wherein the electrode has a plurality of shapes presented concurrently.

17. The EHD evaporator device according to claim 1, wherein the insulation seat comprises a plurality of holes and an indentation portion and is supported by a post of the insulation seat, the plurality of holes being each admittable for an inward refrigerant flow and an outward refrigerant flow and the indentation region being capable of receive a conducting plate therein, through which the electrode and a voltage application end of the voltage application insulation is caused to contact with each other.

18. The EHD evaporator device according to claim 16, wherein the post comprises a hollowed and insulated cylinder.

19. The EHD evaporator device according to claim 18, wherein post further comprises a plurality of small holes.

20. The EHD evaporator device according to claim 1, wherein the electrode is a copper line.

21. The EHD evaporator device according to claim 1, wherein the electrode is a copper plate.

22. The EHD evaporator device according to claim 1, wherein a the electrode is made of stainless iron.

23. The EHD evaporator device according to claim 1, wherein the evaporator is a flooded evaporator.

24. The EHD evaporator device according to claim 1, wherein the plurality of evaporator are connected in serial.

* * * * *